United States Patent [19]

Bakhaus et al.

[11] Patent Number: 4,922,219

[45] Date of Patent: May 1, 1990

[54] CIRCUIT BREAKER

[75] Inventors: Kenneth C. Bakhaus, Jackson; Bruce C. Sdunek, Howell, both of Mich.

[73] Assignee: Mechanical Products, Inc., Jackson, Mich.

[21] Appl. No.: 380,807

[22] Filed: Jul. 17, 1989

[51] Int. Cl.[5] ..... H01H 71/16

[52] U.S. Cl. ..... 337/74; 337/66; 337/75

[58] Field of Search ..... 337/66–75

[56] References Cited

U.S. PATENT DOCUMENTS 3,932,829 1/1976 Ellenberger ..... 337/75

4,167,720 9/1979 Krasser ..... 337/74

*Primary Examiner*—H. Broome

*Attorney, Agent, or Firm*—Lyman R. Lyon

[57] ABSTRACT

A circuit breaker having two subassemblies, connected via snap-lock means, which mesh together to provide manual operation with "trip free" response to overloads and no latch load on the bimetallic element.

9 Claims, 4 Drawing Sheets

CIRCUIT BREAKER

BACKGROUND OF THE INVENTION

The invention relates generally to a circuit breaker and more particularly to an improved circuit breaker which maximizes interruption capacity and life expectancy commensurate with the use of components of minimum complexity that integrate into major subassemblies.

SUMMARY OF THE INVENTION

The instant circuit breaker comprises a manual actuator/latch subassembly which mates with a plunger/-contact subassembly in a snap-together manner. When combined, the subassemblies interact to effect manual circuit engagement and disengagement and automatic circuit disengagement on the occurrence of an overload condition.

DETAILED DESCRIPTION OF THE PREFERRED EMBODIMENT OF THE INVENTION

Figure 1:
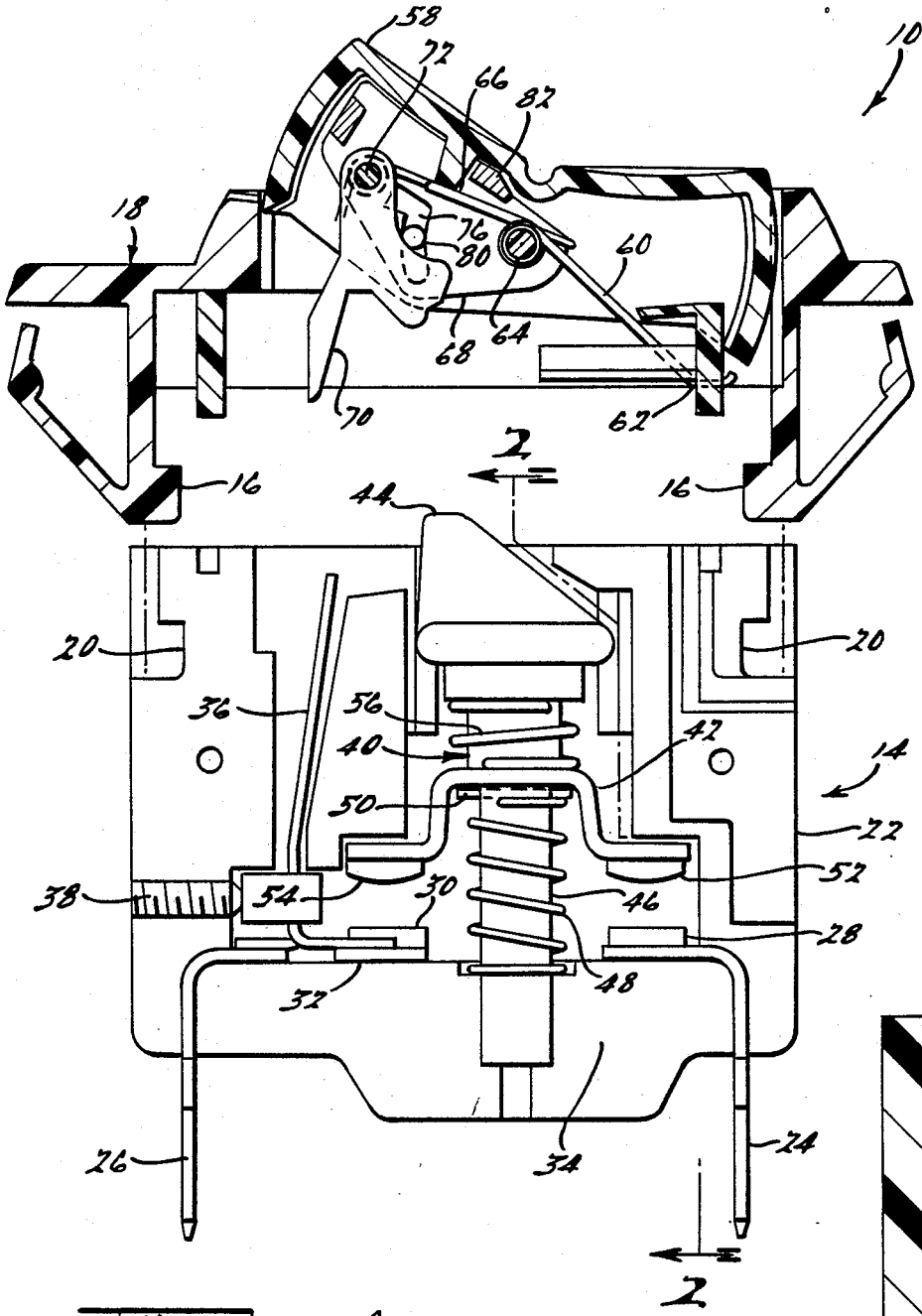
FIG. 1 is an elevational view, partially in cross-section, of a constructed embodiment of the circuit breaker of the instant invention with the subassemblies disassociated.
Figure 2:
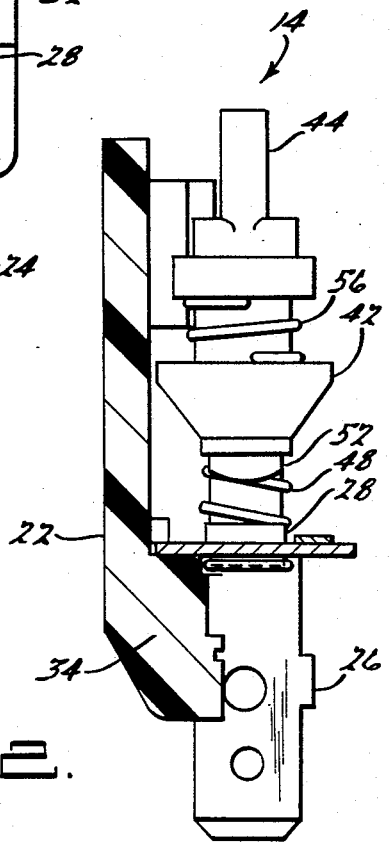
FIG. 2 is a cross-section taken generally along the line 2—2 of FIG. 1.

As best seen in FIG. 1, a circuit breaker 10, in accordance with an exemplary constructed embodiment of the instant invention, comprises a manual actuator-latch subassembly 12 which mates with a plunger-contact subassembly 14. Snap lock shoulders 16 on a manual actuator-latch frame 18 are accepted in complimentary recesses 20 on a plunger-contact housing 22 to position and secure the subassemblies 12 and 14 to one another.

The plunger-contact subassembly 14 comprises the housing 22 having a first terminal 24 and a second terminal 26 extending exteriorly thereof for connection to an electrical source. A first fixed contact 28 is mounted atop the first terminal 24 internally of the plunger-contact assembly 14. A second fixed contact 30 is positioned in lateral alignment with the first fixed contact 28 on a contact support 32 which, in turn, is supported on a base portion 34 of the housing 22.

Figure 7:
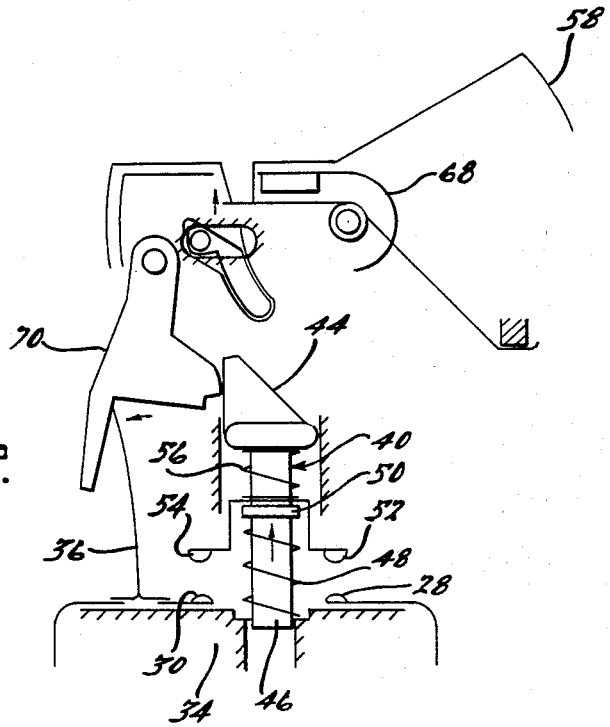
FIG. 7 is a view similar to FIG. 6 showing a first intermediate phase of overload disengagement upon flexure of the bimetallic element.

A current-responsive bimetallic element 36 is connected between the contact support 32 and the second terminal 26. The bimetallic element 36 monitors current in a circuit containing the circuit breaker 10 and reacts to increases in current by bowing outward, as seen in FIG. 7. A calibration screw 38 maintains a bias on the bimetallic element 36 and is accessible externally of the housing 22 to effect calibration of the circuit breaker 10.

A plunger mechanism 40 comprises a contact bridge 42 that extends between the first contact 28 and the second contact 30 for making and breaking an electrical circuit therebetween. A plunger head 44 is disposed at the upper end of a plunger shaft 46 which is slidably journaled in the base 34 of the housing 22. The plunger shaft 46 is upwardly biased by means of a plunger shaft release spring 48 disposed thereabout and extending between the base 34 of the housing 22 and the lower side of a retainer 50 on the plunger shaft 46. The contact bridge 42 supports a pair of contacts 52 and 54 at opposite ends thereof and in vertical alignment with the fixed contacts 28 and 30, respectively. The bridge 42 rests on a top surface of the retainer 50 and moves therewith when the plunger 40 is elevated or depressed during normal breaker operation described below. A contact pressure spring 56 is disposed about the plunger shaft 46, between the plunger head 44 and the upper side of the bridge 42, and applies downward pressure on the contacts 52 and 54 to ensure proper contact pressure when the circuit breaker 10 is closed.

As best seen in FIG. 1, the manual actuator-latch subassembly 12 comprises the frame 18 which supports a manual actuator 58. A manual actuator spring 60 is fixed at one end 62 to the frame 18 and at its center to a locator pin 64, such that a free end 66 biases the manual actuator to the "OFF" condition.

An inner rocker 68 is integrated with the manual actuator 58 providing means for cooperating with the plunger mechanism 40 to maintain circuit continuity under normal operation as described below. A trip lever 70, is pivotally supported on the inner rocker 68 by a pin 72. On assembly, the trip lever 70 is automatically positioned so as to engage the head 44 on the plunger shaft 46.

Figure 3:
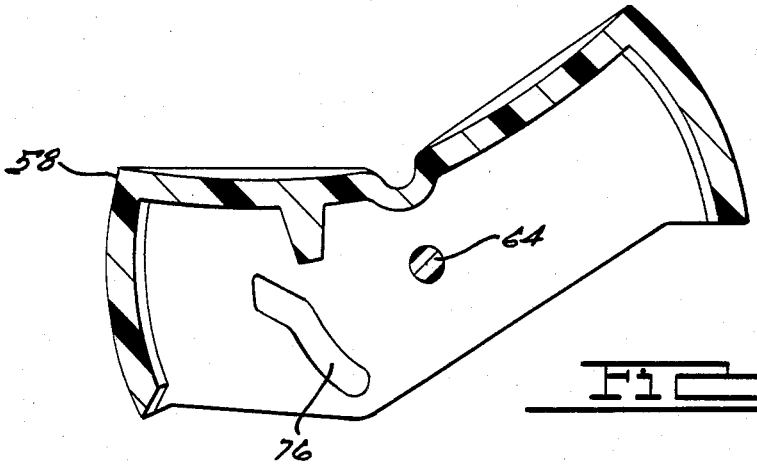
FIG. 3 is an elevational view of the manual actuator.
Figure 4:
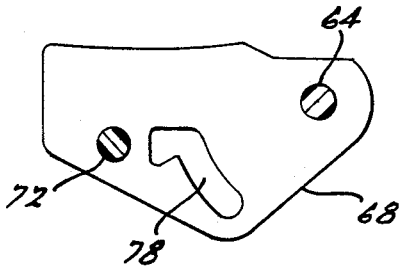
FIG. 4 is an elevational view of the inner rocker of the manual actuator-latch mechanism.
Figure 5:
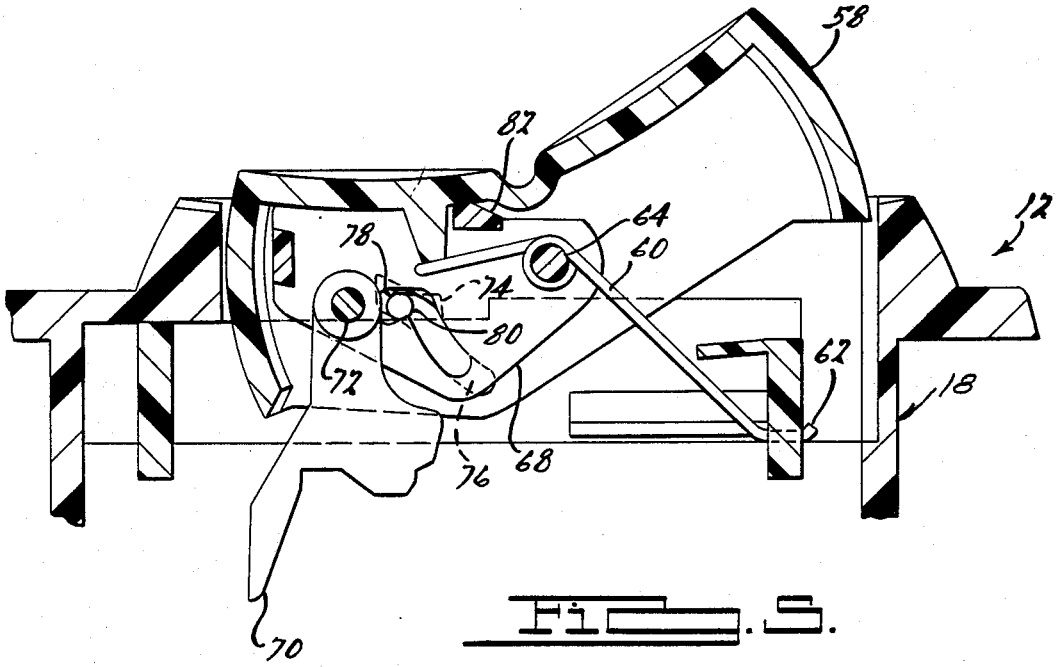
FIG. 5 is a partial cross-section of the manual actuator-latch subassembly of FIG. 1.
Figure 6:
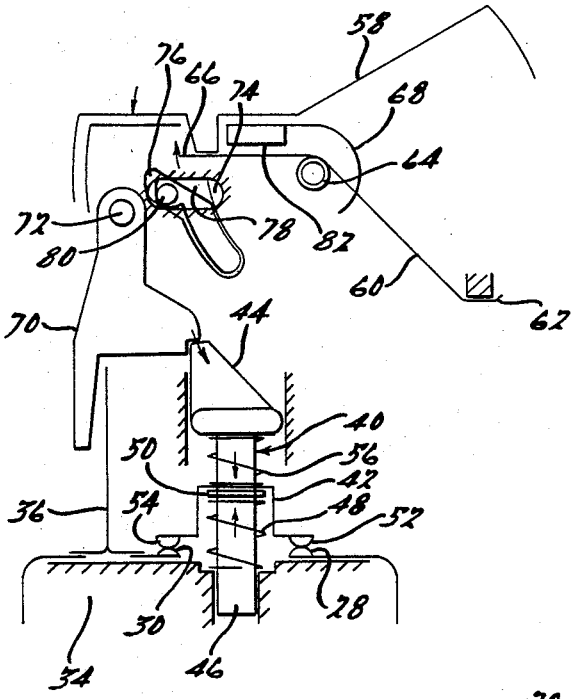
FIG. 6 is a diagrammatic view of the circuit breaker of FIG. 1 in a steady state engaged mode.

In operation, counterclockwise movement of the manual actuator 58 to the position shown in FIG. 3 (hereinafter referred to as the "ON" position) effects engagement of the trip lever 70 with a cooperating surface on the plunger head 44 thus depressing the plunger mechanism 40 against the force of the plunger shaft release spring 48. The contact bridge 42 travels with the plunger mechanism under the bias of the contact pressure spring 56 to complete the circuit to be monitored.

The aforementioned contacts closed condition is maintained by means of a pin/slot arrangement comprising a manual actuator frame slot 74, a manual actuator slot 76, an inner rocker slot 78 and a latch pin 80 which moves within the three control slots. Manual breaker activation is realized by switching the actuator 58 to the "ON" position whereby manual actuator slot 76 guides the latch pin 80 leftward within the control slots 74 and 78. The latch pin 80 is retained in a cradle formed in the inner rocker slot 78 by means of the upward force transmitted through the trip lever 70 from the plunger shaft release spring 48 thus preventing release of the inner rocker 68 against force from the manual actuator spring 60.

As best seen in FIG. 7, on circuit overload the bimetallic element 36 bows outward and contacts a protrusion of the trip lever 70 thus dissociating the trip lever 70 from the plunger head 44. The force from the plunger shaft release spring 48 then thrusts the plunger mechanism 40 upward disengaging the contacts 28 and 52, and 30 and 54, respectively, and breaking circuit continuity. As this motion is independent of the manual actuator 58 position, "trip free" response to overload is provided.

Figure 8:
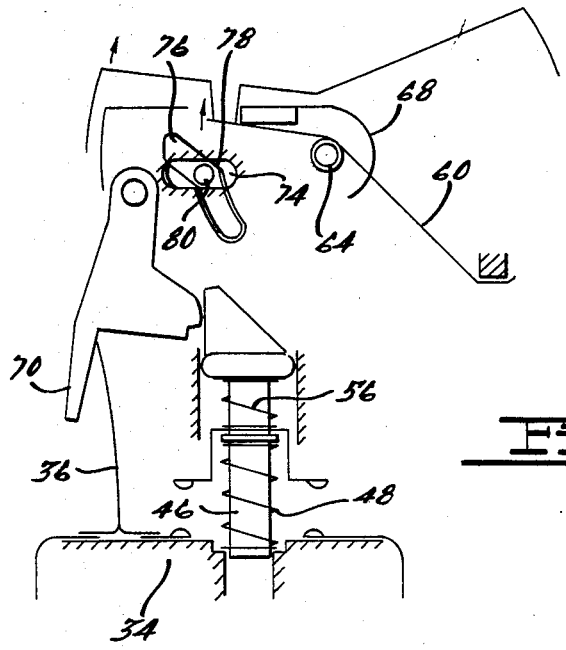
FIG. 8 is a view similar to FIG. 7 showing a second intermediate phase of overload disengagement wherein the latch pin is freed from the cradle and begins travel.
Figure 9:
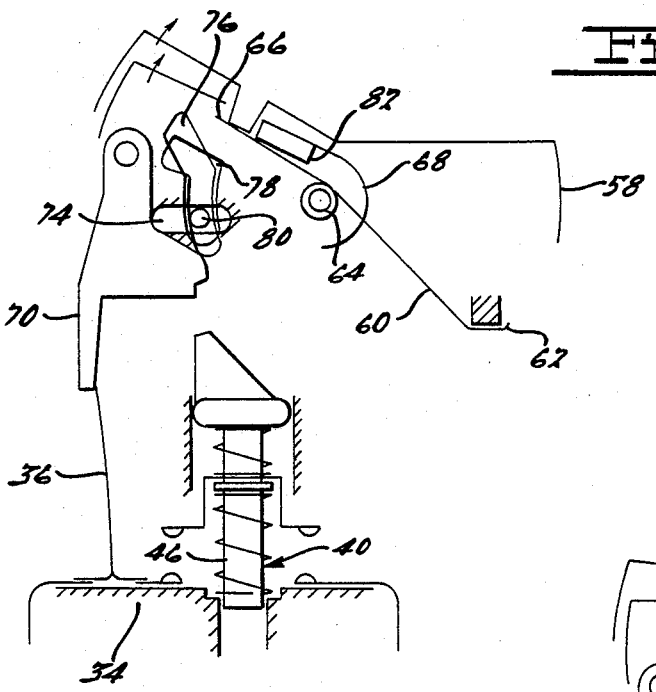
FIG. 9 is a view similar to FIG. 8 showing a final phase of overload disengagement wherein the manual actuator is moved to its "OFF" position under spring force.

As best seen in FIG. 8, release of the trip lever 70 relieves the upward force retaining the latch pin 80 in the inner rocker slot 78. The latch pin 80 succumbs to the upward force experienced by the manual actuator 58 due to the actuator spring 60 and is guided from the cradle by manual actuator slot 76 thus releasing the inner rocker 68 and resetting the trip lever 70 for re-engagement, as in FIG. 9.

Figure 10:
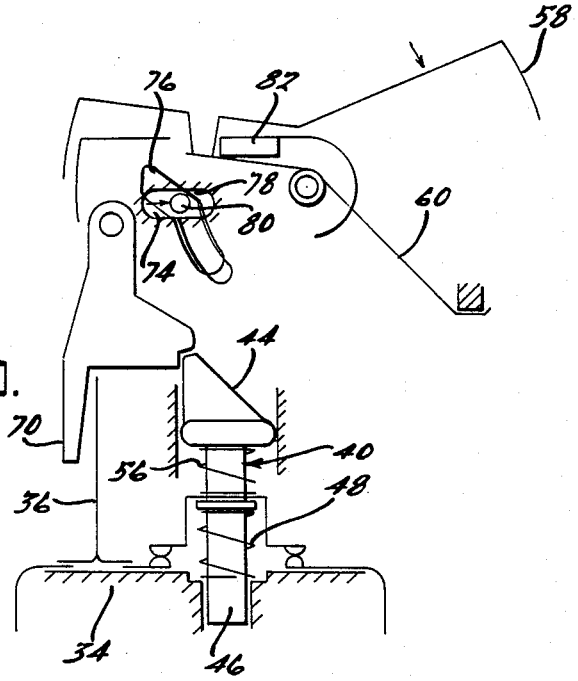
FIG. 10 is a view similar to FIG. 6 illustrating a first phase of manual disengagement by depressing the manual actuator to the "OFF" position.
Figure 11:
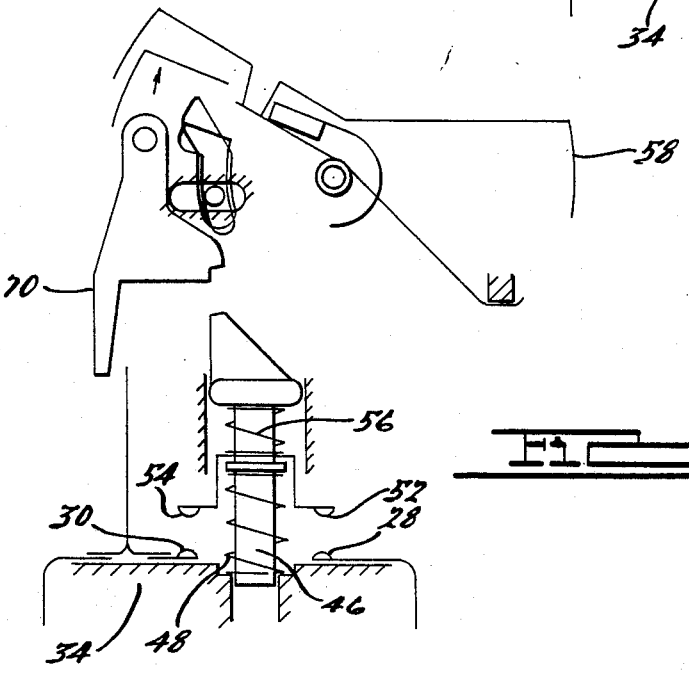
FIG. 11 is a view similar to FIG. 10 showing a second phase of manual disengagement wherein the trip lever is lifted from the plunger breaking contact.

As best seen in FIG. 10, manual breaker disengagement is realized by pressing down on the right side of the manual actuator 58 (hereinafter the "OFF" position) thus transmitting a force to the manual actuator slot 76 sufficient to overcome the retaining forces on the latch pin 80. The latch pin 80 then moves rightward, escaping the cradle as above. The actuator spring 60 forces the manual actuator 58 upwards, catching a latch lug 82, and rotating both the manual actuator 58 and the inner rocker 68 to the "OFF" position. The trip lever 70 travels upward with the inner rocker 68 and is dissociated from the plunger head 44. The plunger mechanism 40 is thrust upward under force from the plunger shaft release spring 48 disengaging the contacts 28 and 52, and 30 and 54, respectively, and breaking the circuit, as in FIG. 11.

While the preferred embodiment of the invention has been disclosed, it should be appreciated that the invention is susceptible of modification without departing from the spirit of the invention or the scope of the subjoined claims.

We claim:

1. An electrical circuit breaker comprising a plunger-contact subassembly and a manual actuator-latch subassembly wherein said plunger-contact subassembly comprises a housing having means for removably engaging said manual actuator-latch subassembly:

a pair of terminals disposed internally of said housing and protruding externally therefrom for connection to a source of electrical current;

a first fixed contact disposed internally of said housing and connected to one of said terminals;

a second fixed contact disposed internally of said housing;

an elongated bimetallic element assembly connected to the other of said terminals and to said second fixed contact;

a plunger shaft located intermediate said first and second fixed contacts and moveable relative thereto;

a contact bridge supported by said plunger shaft and moveable therewith;

first and second moveable contacts mounted at opposite ends of said contact bridge and aligned with said first and second fixed contacts, respectively;

a contact pressure spring supported by said plunger shaft providing a constant bias on said moveable contacts towards said fixed contacts;

a plunger shaft release spring intermediate said contact bridge and said housing providing a constant bias on said plunger shaft away from said housing;

said actuator-latch subassembly comprising a manual actuator frame having means engageable with the engagement means of said plunger-contact subassembly for joining said subassemblies, said manual actuator frame having a first latch pin control slot;

a manual actuator supported for rotation by said manual actuator frame and having a second latch pin control slot;

an inner rocker supported for rotation by said manual actuator and having a third latch pin control slot;

a trip lever supported for rotation by said inner rocker and engageable with said plunger shaft and with said bimetallic element, deflection of said bimetallic element due to an overload condition in an electrical circuit containing said circuit breaker effecting disengagement of said trip lever from said plunger shaft whereby said moveable contacts disengage from said fixed contacts; and a latch pin extending through each of the first, second and third latch pin control slots in said manual actuator frame, manual actuator, and inner rocker, respectively, wherein said control slots direct the latch pin travel in response to manual operation or circuit overload and provide a cradling means whereby said latch pin is retained under the bias of said plunger shaft release spring to effect latching.

2. A circuit breaker in accordance with claim 1 wherein the first, second, and third latch pin control slots comprise a horizontally oriented slot in said manual actuator frame, an inclined slot in said manual actuator, and an inclined slot in said inner rocker, the slot in said inner rocker having said latch pin cradling means therein, whereby said latch pin travels along the slot in said manual actuator frame upon rotation of the manual actuator and the inner rocker upon manual actuation and is retained under the bias of said plunger shaft release spring in the cradling means of the inner rocker slot to effect latching, movement of said manual actuator slot forcing the latch pin out of said cradling means.

3. A circuit breaker in accordance with claim 1 wherein said manual actuator and said inner rocker are mounted on a common shaft.

4. A circuit breaker in accordance with claim 1 wherein said manual actuator-latch subassembly further comprises a manual actuator release spring biasing said manual actuator and said inner rocker to an "OFF" position.

5. A circuit breaker in accordance with claim 1 wherein said bimetallic element is responsive to current flow therethrough, said bimetallic element being bifurcated with two leads disposed along the housing base at said second fixed contact and said other terminal, respectively, said second fixed contact being mounted on a contact support on the housing base so as to be in lateral alignment with said first fixed contact.

6. An electrical circuit breaker comprising a plunger-contact subassembly and a manual actuator-latch subassembly wherein said plunger-contact subassembly comprises a housing having means for removably engaging said manual actuator-latch subassembly;

a pair of terminals disposed internally of said housing and protruding externally therefrom for connection to a source of electrical current;

a first fixed contact disposed internally of said housing and connected to one of said terminals;

a second fixed contact disposed internally of said housing;

an elongated bimetallic element assembly connected to the other of said terminals and to said second fixed contact;

a plunger shaft located intermediate said first and second fixed contacts and moveable relative thereto;

a contact bridge supported by said plunger shaft and moveable therewith;

first and second moveable contacts mounted at opposite ends of said contact bridge and aligned with said first and second fixed contacts, respectively;

a contact pressure spring supported by said plunger shaft providing a constant bias on said moveable contacts towards said fixed contacts;

a plunger shaft release spring intermediate said contact bridge and said housing providing a constant bias on said plunger shaft away from said housing:

said actuator-latch subassembly comprising a manual actuator frame having means engageable with the engagement means of said plunger-contact subassembly for joining said subassemblies, said manual actuator frame having a horizontally oriented first latch pin control slot;

a manual actuator supported for rotation by said manual actuator frame and having an inclined second latch pin control slot;

an inner rocker supported for rotation by said manual actuator and having an inclined third latch pin control slot having latch pin cradling means therein;

a trip lever supported for rotation by said inner rocker and engageable with said plunger shaft and with said bimetallic element, deflection of said bimetallic element due to an overload condition in an electrical circuit containing said circuit breaker effecting disengagement of said trip lever from said plunger shaft whereby said moveable contacts disengage from said fixed contacts; and a latch pin extending through each of the first, second and third latch pin control slots in said manual actuator frame, manual actuator, and inner rocker, respectively, whereby said latch pin travels along the slot in said manual actuator frame upon rotation of the manual actuator and the inner rocker upon manual actuation and is retained under the bias of said plunger shaft release spring in the cradling means of the inner rocker slot to effect latching, movement of said manual actuator slot forcing the latch pin out of said cradling means.

7. A circuit breaker in accordance with claim 6 wherein said manual actuator and said inner rocker are mounted on a common shaft.

8. A circuit breaker in accordance with claim 6 wherein said manual actuator-latch subassembly further comprises a manual actuator release spring biasing said manual actuator and said inner rocker to an "OFF" position.

9. A circuit breaker in accordance with claim 6 wherein said bimetallic element is responsive to current flow therethrough, said bimetallic element being bifurcated with two leads disposed along the housing base at said second fixed contact and said other terminal, respectively, said second fixed contact being mounted on a contact support on the housing base so as to be in lateral alignment with said first fixed contact.

* * * * *